US007162969B2

(12) United States Patent
Houlder et al.

(10) Patent No.: US 7,162,969 B2
(45) Date of Patent: Jan. 16, 2007

(54) BOAT PLATFORM

(75) Inventors: Simon Houlder, Kidderminster (GB); Roger Tucker, Kidderminster (GB); Geoffrey Wyle, Kidderminster (GB); Gerard Bernard Wainwright, Church Stretton (GB)

(73) Assignee: Sealine International Limited (GB)

( * ) Notice: Subject to any disclaimer, the term of this patent is extended or adjusted under 35 U.S.C. 154(b) by 0 days.

(21) Appl. No.: 10/451,403

(22) PCT Filed: Dec. 21, 2001

(86) PCT No.: PCT/GB01/05762

§ 371 (c)(1),
(2), (4) Date: Mar. 25, 2004

(87) PCT Pub. No.: WO02/051698

PCT Pub. Date: Jul. 4, 2002

(65) Prior Publication Data

US 2004/0144296 A1 Jul. 29, 2004

(30) Foreign Application Priority Data

Dec. 22, 2000 (GB) ..... 0031561.4

(51) Int. Cl.
*B63B 17/00* (2006.01)

(52) U.S. Cl. ..... 114/362

(58) Field of Classification Search ..... 114/343, 114/362, 364, 365, 366, 375
See application file for complete search history.

(56) References Cited

U.S. PATENT DOCUMENTS

| | | | | | |
|---|---|---|---|---|---|
| 3,588,160 | A | * | 6/1971 | Reiner | 293/119 |
| D243,854 | S | * | 3/1977 | Pelkey | D25/63 |
| 4,548,155 | A | * | 10/1985 | Hegg et al. | 144/362 |
| 4,708,087 | A | * | 11/1987 | Potter, Jr. | 114/352 |
| 4,719,989 | A | * | 1/1988 | Ritten | 182/93 |
| 4,738,642 | A | | 4/1988 | Koyama et al. | |
| 5,085,164 | A | | 2/1992 | Whitton | |
| 5,140,923 | A | | 8/1992 | Wood | |
| 5,228,707 | A | * | 7/1993 | Yoder | 280/166 |
| 5,613,462 | A | | 3/1997 | Schwartz | |
| 6,047,659 | A | * | 4/2000 | Schmidt, Jr. | 114/369 |
| 6,182,598 | B1 | * | 2/2001 | Bozzo | 114/362 |

FOREIGN PATENT DOCUMENTS

| | | |
|---|---|---|
| DE | 10 77 096 B | 3/1960 |
| DE | 19602331 A1 | 7/1997 |
| FR | 2 689 085 A | 4/1988 |
| FR | 2 674 212 A | 9/1992 |
| GB | 1331741 A | 9/1973 |

OTHER PUBLICATIONS

Int'l Search Report (PCT/GB01/05762).
UK Search Report (GB 0031561.4).

* cited by examiner

*Primary Examiner*—Sherman Basinger
(74) *Attorney, Agent, or Firm*—Duane Morris LLP

(57) ABSTRACT

A platform unit (2) is seated on the tail (5) of a hull (1) of a boat and may be lowered by powered actuator means (8) down guides (7) on an incline (6) to descend into the water. This exposes steps (62) in the incline which function with steps (213) in the platform unit (2) to enable a swimmer to climb up out of the water onto the main boat deck.

33 Claims, 10 Drawing Sheets

BOAT PLATFORM

BACKGROUND OF THE INVENTION

The invention relates to a platform that may be provided on a boat and moved towards and away from the water to facilitate persons leaving and entering the water and lowering and raising objects such as dinghies in and out of the water.

U.S. Pat. No. 5,690,045 discloses a personal watercraft lift for the transom of a boat. The lift comprises a horizontal platform which projects from the stern of the boat at the transom and may be vertically raised and lowered by a mechanism contained within the hull at the transom end.

This is a comparatively unattractive arrangement in that the platform is always permanently visible as such. It projects beyond the back of the boat thus lengthening the boat, and is also exposed to being damaged during use of the boat.

SUMMARY OF THE INVENTION

According to one aspect of the invention, there is provided a boat comprising:

a hull;

a platform unit having a stowed position on the hull at the stern of the boat; and guide means for guiding the platform unit to move backwards and downwards away from the stowed position.

Because the platform unit is stowed on the hull, it is less likely to be damaged when it is not being used. Also, the platform unit may be configured in terms of shape so as to appear to be a portion of the hull, and thus the platform unit has a more attractive appearance when stowed.

Usually, the guide means comprises at least one elongate guide device carrying the platform unit and mounted inclined on the stern of the hull. For example, the or each guide device is a longitudinally-expandable device having a movable member carrying the platform unit and a static guide on the stern of the hull.

The guide device may therefore function to project the platform unit rearwardly of the stern or transom of the hull when the platform unit is deployed away from its stowed position. There may in some circumstances be a small remaining overlap between the front end of the platform unit and the rear underlying part of the hull. It is convenient to use telescopic devices as the longitudinally-expandable devices.

In our preferred embodiment, the static guide is a track inclined on the stern of the hull and the movable member is a beam slidably supported by the track. Usually, there will be two guide devices forming tracks at approximately one thirds and two thirds distance across the width of the rear of the hull.

Preferably, the hull has a rearwardly and upwardly facing incline above the waterline at the stern of the boat and the guide means is provided in or on the incline. In our preferred embodiment, the guide means is substantially fully recessed into the hull at the incline in order to appear to be hidden and to present less of an obstacle to users of the boat when climbing up and down the incline when the platform unit is deployed. The incline may define one or more sliding or glide surfaces that conform to and complement the shape of the underside of the platform unit so that the platform unit appears to slide or glide up and down the slope provided by the incline from the upper stowed position to the lower deployed position.

Preferably, the hull at the stern has steps which are revealed when the platform unit is moved backwards and downwards away from its stowed position. The steps are only needed when the platform unit is lowered into the water and thus they are only revealed for use when they are so needed. When the platform unit is raised and the steps are not needed, the steps are hidden, which gives an attractive overall appearance.

In our preferred embodiment, the rear edge of the platform unit has steps. Thus, there may be provided a flight of steps in the stern which are revealed when the platform is lowered and a flight of steps in the rear of the platform unit, with both flights being aligned so as to combine to present an overall flight of steps which may be used to walk all the way out of the water up to a deck of the boat.

Preferably, the platform unit comprises a housing having one or more upper platform surfaces. The housing may be given an appearance which complements that of the adjacent portions of the hull so that the platform unit appears when raised to be a part of the overall envelope of the hull rather than an obviously-protruding addition.

Thus, it is preferred that the housing has sides which, at least in the stowed position, give the platform unit a width substantially the same as the width between the adjacent side wall parts of the hull.

Also, it is preferred that the housing has a rear which in the stowed position is slightly behind, level with or in front of the adjacent rear wall of the hull.

Relative to the waterline of the boat, the platform unit when in the stowed position is substantially out of the water and when deployed backwards and downwards is more fully submerged in the water. In many embodiments the platform unit when deployed has the or each upper platform surface submerged.

In most embodiments, the platform unit when deployed is fully submerged. Apart from enabling swimmers to sit on a slightly submerged platform, this arrangement would also enable a marine item such as a dinghy to be floated to over or above the platform unit and then raised out of the water by lifting the platform unit up onto the back of the hull. A cradle or the like or other supports could be provided on the platform unit to support the dinghy.

In our preferred embodiment, there is provided powered actuator means for moving the platform unit along the guide means.

The motor(s) used to power the actuator means may be located inside the hull, e.g. underneath the guide means. The actuator means and the guide means may be made integral with one another to form a track or trackway which may then be fitted as a unit to the hull of the boat.

In a preferred embodiment, the platform unit is generally wedge-shaped in side profile.

According to another aspect of the invention, there is provided a platform unit for a boat comprising a housing having one or more upper platform surfaces, the bottom of the housing being inclined to the horizontal to give the platform unit a wedge shape in side profile.

In a preferred embodiment, the rear and top of the housing are cut away at the upper rear portion of the platform unit to provide a flight of steps.

Preferred embodiments of the present invention will now be described with reference to the drawings which are diagrammatic or schematic.

DESCRIPTION OF THE PREFERRED EMBODIMENTS

Figure 1:
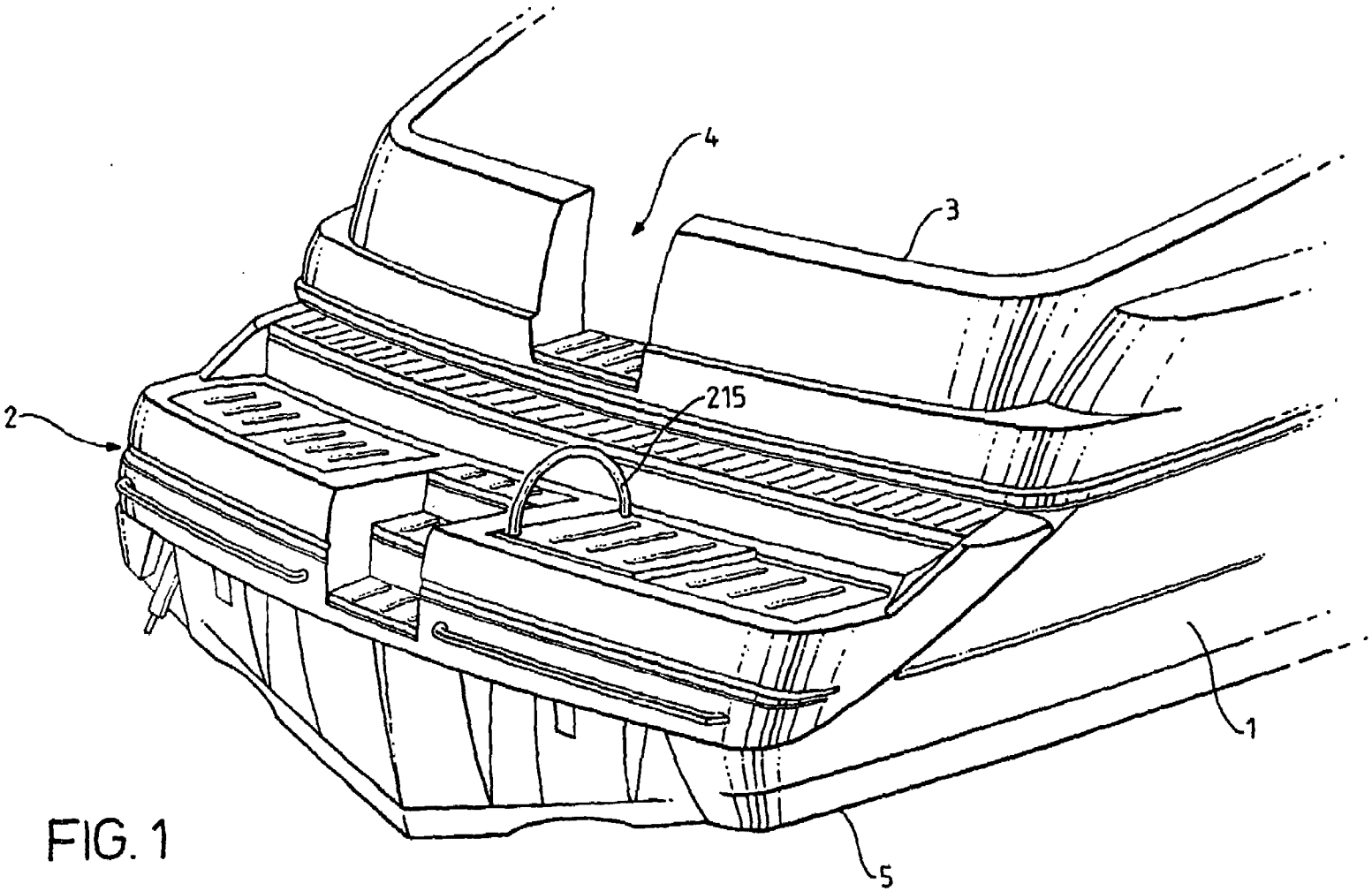
FIG. 1 is a perspective view of the rear of a boat showing the platform unit thereof in its raised position.
Figure 2:
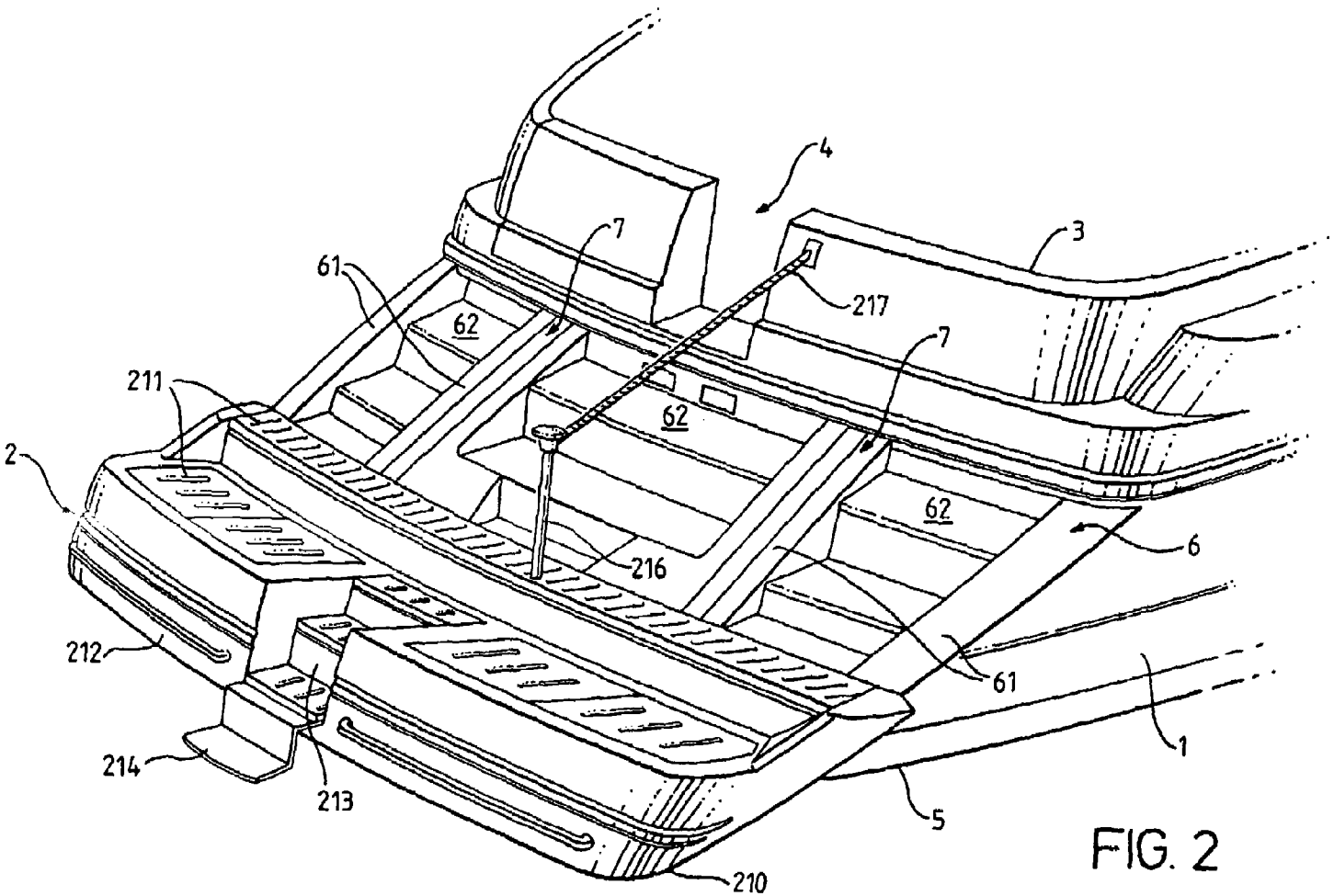
FIG. 2 is a perspective view showing the platform unit lowered to its deployed position.

FIGS. 1 and 2 show the stern of a boat having a hull 1 and a platform unit 2 which may be raised and lowered along an inclined path over the rear end of the hull.

On top of the hull 1 is a parapet 3 which surrounds a rear deck (not shown). The parapet 3 has an aperture 4 for providing access onto and off the platform unit 2 from the rear deck.

The hull 1 has its stern or transom shaped to provide a tail 5 on which the platform unit 2 is seated when in its raised position. The platform unit 2 is substantially the same overall width as the width of the adjacent side wall parts of the hull 1, when the platform unit 2 is in its raised position. At the same time, the rear of the platform unit is substantially at the same longitudinal position along the boat axis as the rear of the hull tail 5. Thus, when raised, the platform unit 2 appears substantially to be a continuation of the envelope defined by the hull 1. This makes the platform unit appear to be part of the hull. In fact, the platform unit appears like a wedge-shaped slice or segment that has been cut off from the hull and rested back into position, when in its raised position. When deployed downwards to its lowered position shown in FIG. 2, the platform unit does of course move relative to the hull.

The hull tail 5 defines an upwardly and rearwardly facing incline or slope 6 up and down which the platform unit 2 is able to slide. As shown in FIG. 2, the slope 6 comprises a plurality of transversely spaced apart sloped surfaces 61 between which are incised flights of steps 62 which also function as seats so that a person may either walk down the steps to the platform, when the platform unit is lowered, or else sit on the steps for activities such as fishing.

The platform unit 2 comprises a housing or shell 210 on the top of which are two platform surfaces 211 which are stepped relative to one another. When the platform unit is stowed at its upper position, the upper platform surface 211 is substantially at the level of the rear deck in front of the parapet 3. Thus the upper platform surface 211 appears to be a continuation of the rear deck. Incised into the lower platform surface 211 and into the rear face 212 at a central position is a flight of steps 213 which may have a flip-down step extension 214.

Thus, when the platform unit is lowered, so as to be partially or entirely immersed, a swimmer may swim towards the boat and then walk up the steps 213 and up the steps 62 and through the aperture 4 onto the rear deck of the boat.

A hand-hold hoop rail 215 may be provided as shown in FIG. 1. Alternatively or additionally, as shown in FIG. 2, a post 216 may be provided on the platform unit 2 so as to pull out a retractable hand rail 217 from the parapet 3 when the platform unit 2 is lowered. The hoop rail 215 and the hand rail 217 provide assistance to a swimmer walking up from out of the water onto the deck of the boat.

It may be seen from FIG. 1 that, when raised, the platform unit 2 is substantially entirely seated on the hull tail 5 with only a small proportion, if any, of the platform unit projecting rearwardly over the rear end of the hull. Preferably, at least 50%, more preferably 80%, more preferably 90%, more preferably 95%, of the length of the platform unit 2 in the longitudinal direction of the boat is seated above the hull 1 when the platform unit 2 is in its stowed position.

Figure 3:
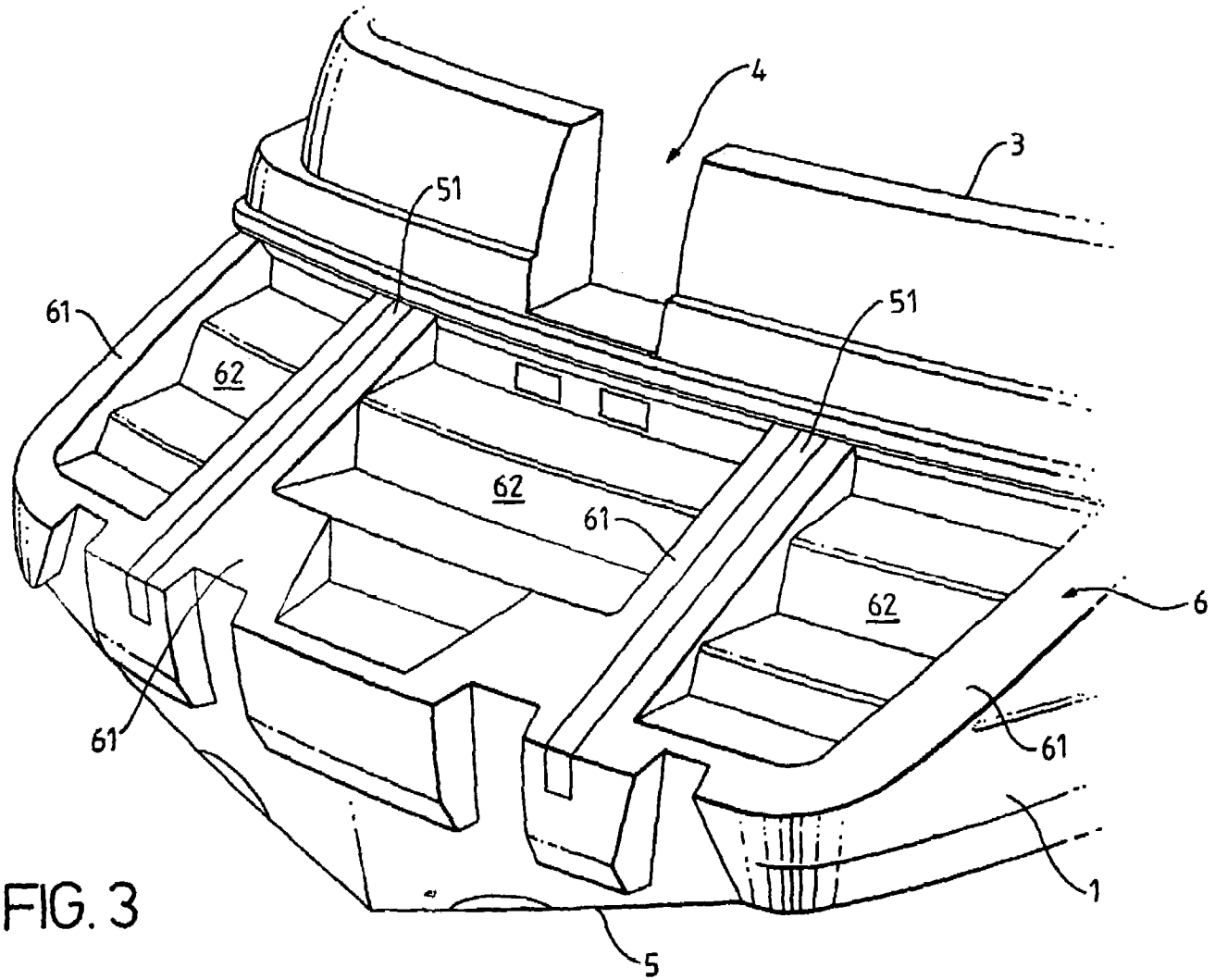
FIG. 3 is a perspective view showing the stern of the boat with the platform unit and guide means unfitted.
Figure 4:
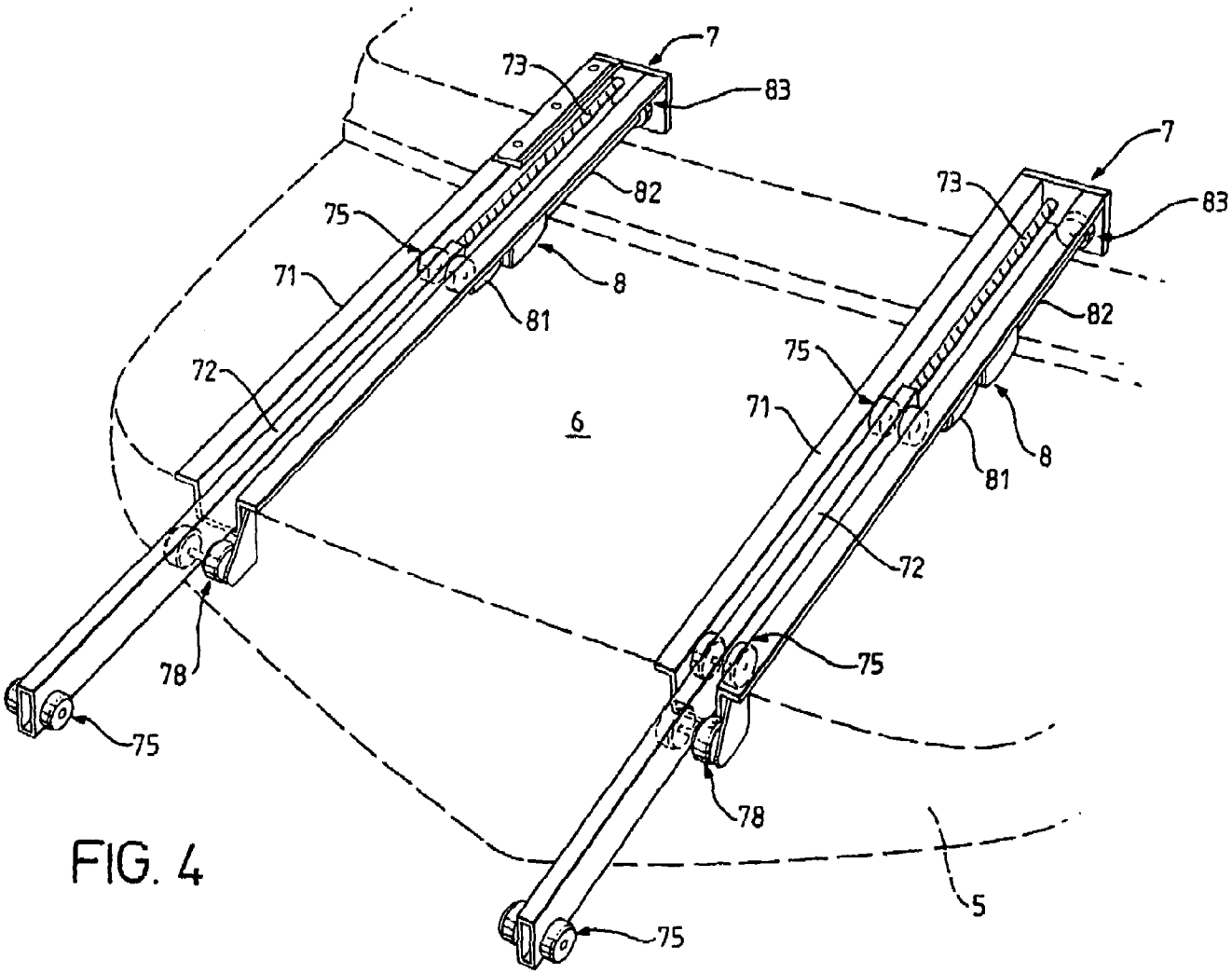
FIG. 4 is a perspective view showing the guide means and powered actuator means ready for fitting with the outline of the hull being shown in dotted line.

FIG. 3 shows the rear end of the boat when the platform unit 2 and the guide means and powered actuator means are unfitted. The guide means 7 and their integral powered actuator means 8 are shown in FIG. 4.

The guide means 7 is of a telescopic construction. There is a static guide trough 71 which is fixed to the hull 1. A movable beam 72 is slidably received in the trough 71 and is supported therein by rollers provided on the trough or on the beam. Also received within the trough 71 is a leadscrew 73 which engages a nut provided in the beam 72 so that rotation of the leadscrew 73 will drive the beam 72 up and down the trough 71.

The leadscrew 73 is powered by a hydraulic motor 81 of the powered actuator means 8 acting through a drive shaft 82 and a gear and belt arrangement 83.

Many of the components of the guide means 7 and powered actuator means 8 are made of stainless steel so as to suit the marine environment.

Each guide means 7 is assembled as an integral unit with its powered actuator means 8 to form a track unit. The two track units are then fitted in respective inclined channels 51 in the hull tail 5, as shown in FIG. 3. Then, the platform unit 2 is fixed to the movable beams 72.

Figure 5:
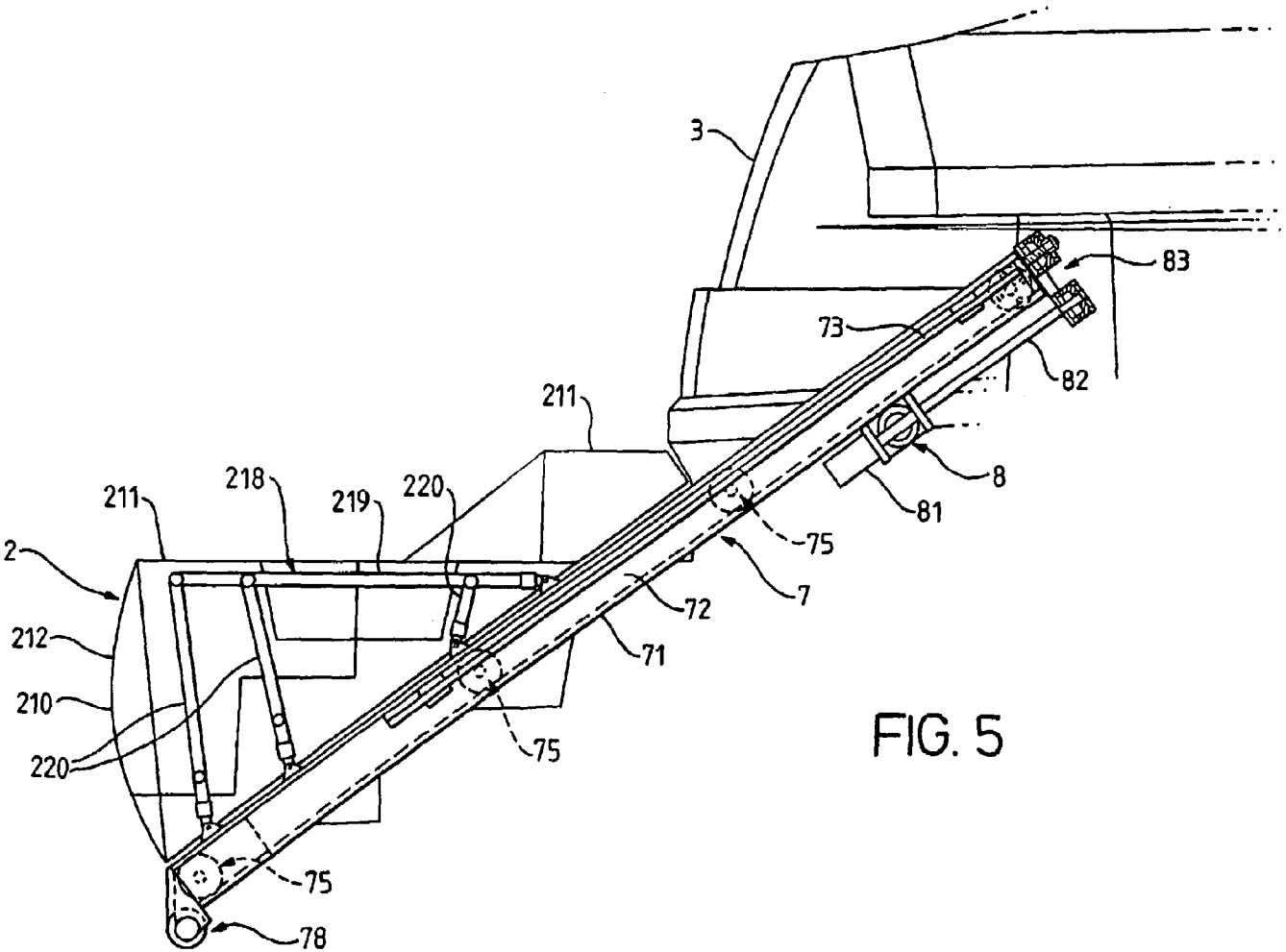
FIG. 5 is a side view showing the platform unit when raised.

As shown in FIG. 5, the platform unit 2 has a structural framework 218 provided within the outer envelope of the shell 210. The framework 218 comprises a series of upper members 219 supported on legs 220. The bottoms of the legs 220 and the right hand end of the upper members 219 are fixed to the movable beams 72. The shell 210 is then supported on the framework 218. The angle of the incline of the path of movement of the platform unit 2 is shown in FIG. 5 as being 54° from the vertical. This is equivalent to 36° from the horizontal. The range of incline as measured from the horizontal may be from 28° to 44° for example.

Figure 6:
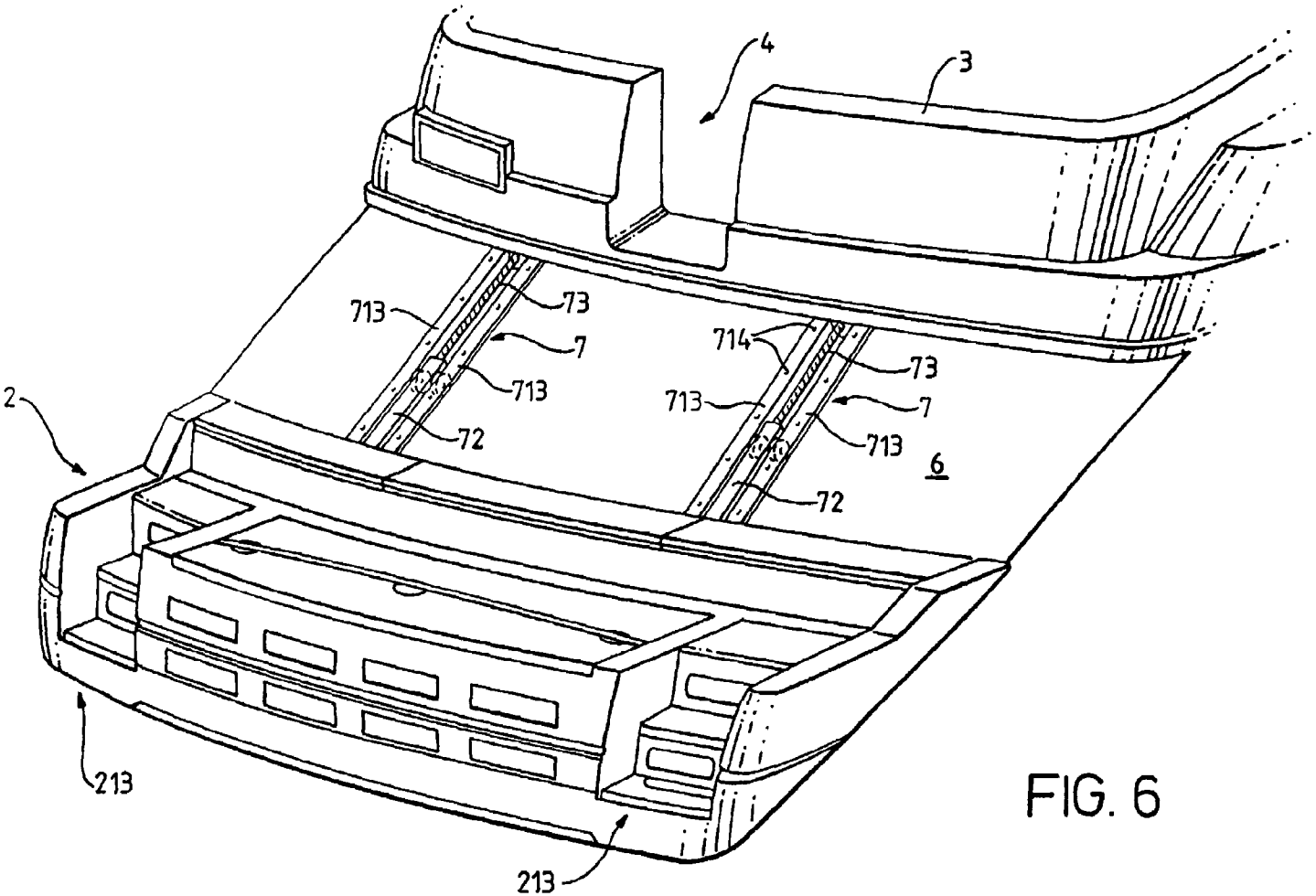
FIG. 6 is a perspective view showing a variant of the platform unit with two flights of integral steps when deployed downwards.

FIG. 5 shows the platform unit when raised. FIG. 6 shows a variant when lowered. When lowered, the movable beams 72 are supported in a cantilevered manner in the guide troughs 71 so as to project out beyond the back end of the hull.

Figure 7:
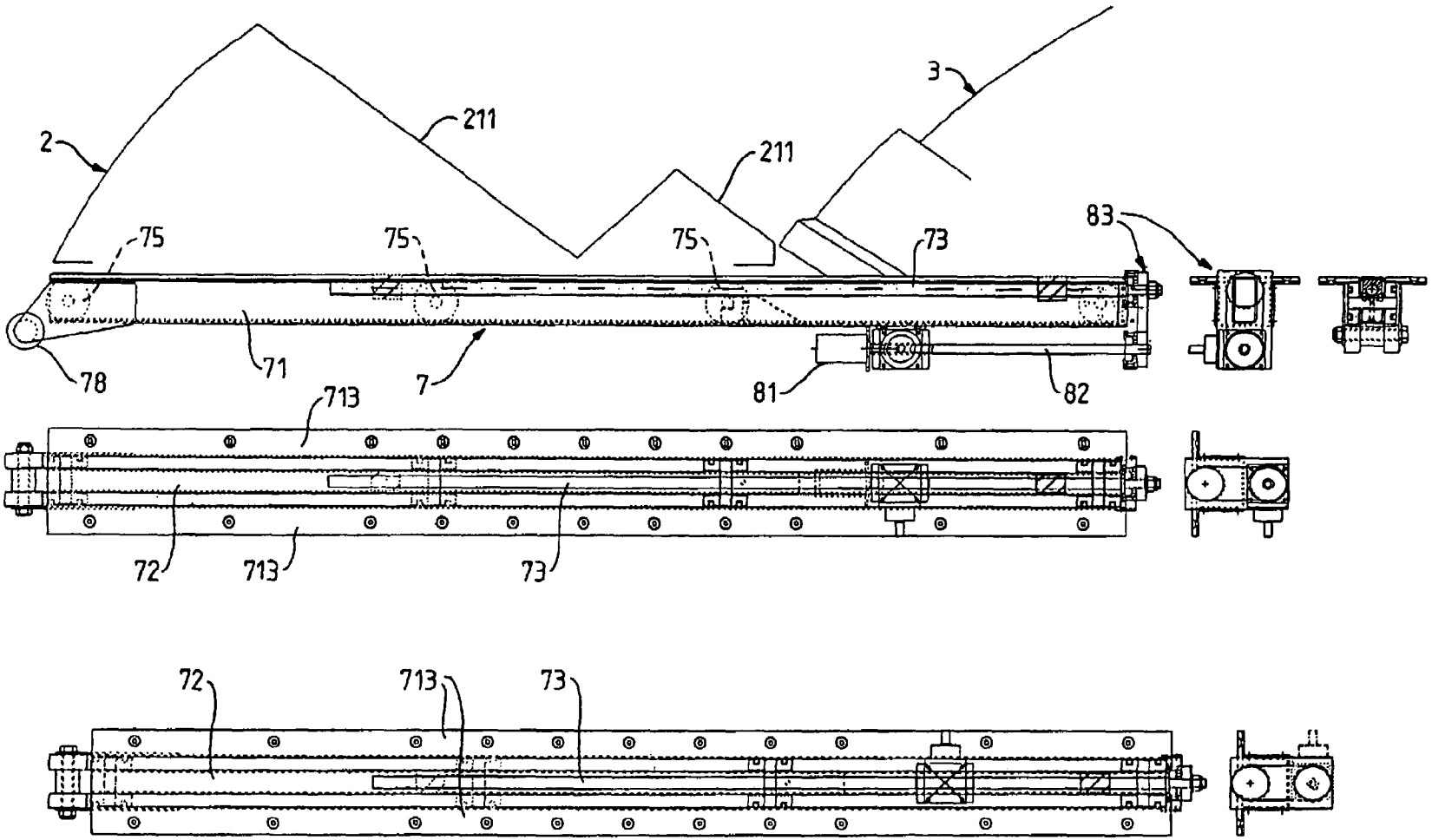
FIG. 7 is a series of views showing an integral guide means and powered actuator means.

FIG. 7 shows the guide means 7 and powered actuator means 8 in a variety of views.

Figure 8:
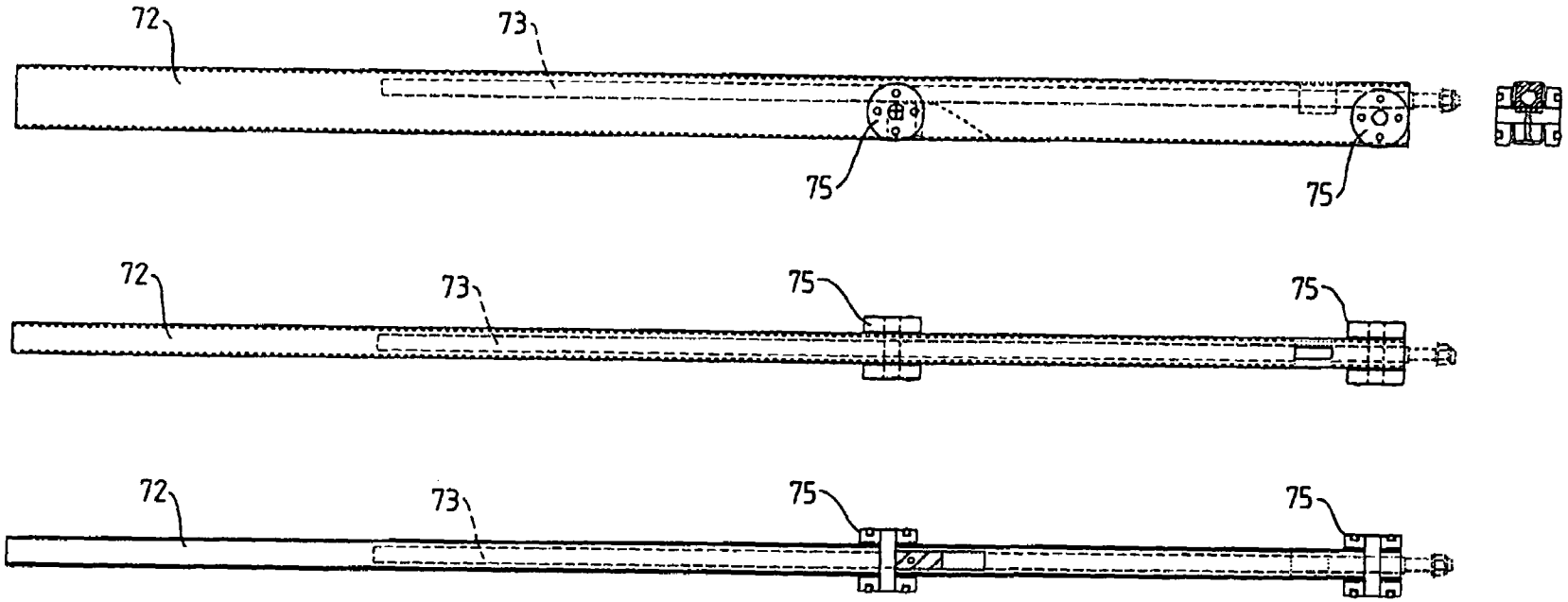
FIG. 8 is a series of views showing the movable beam of one of the telescopic guide means.

FIG. 8 shows the movable beam 72 viewed from different directions.

Figure 9:
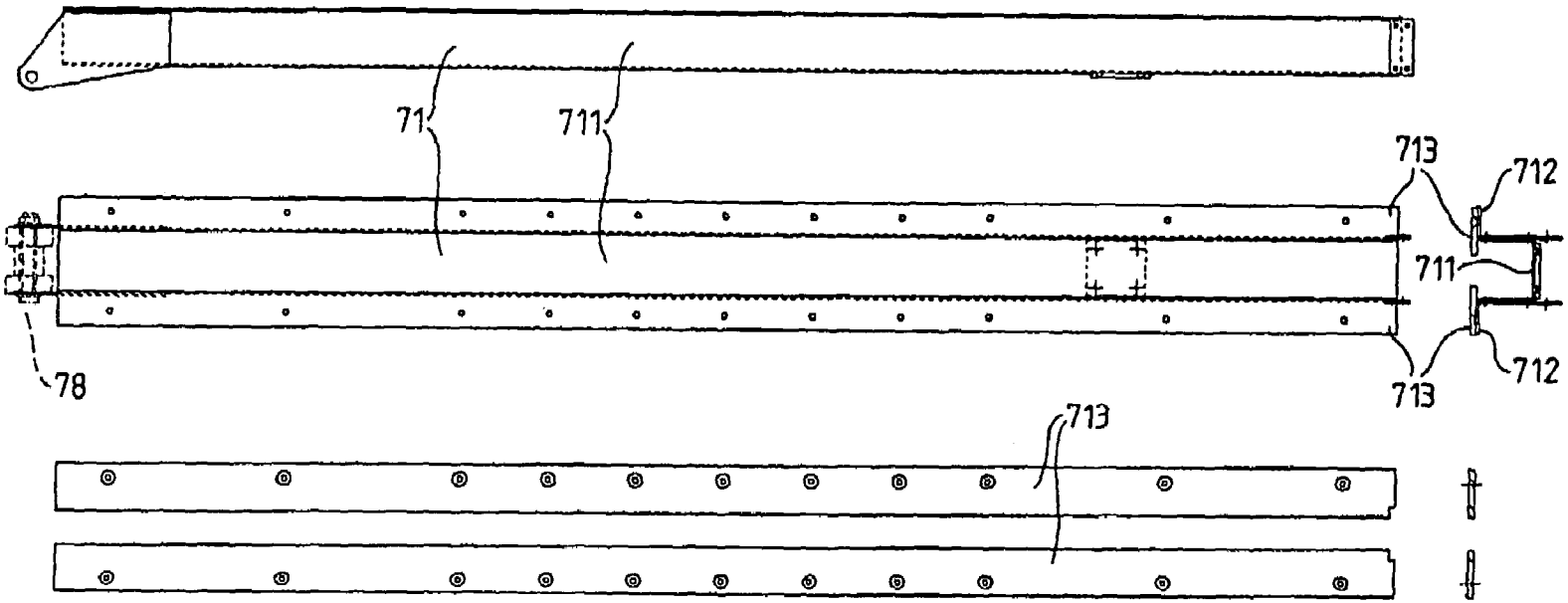
FIG. 9 is a series of views showing one of the static guides of the telescopic guide means.

FIG. 9 shows the guide trough 71 viewed from different directions.

Figure 10A:
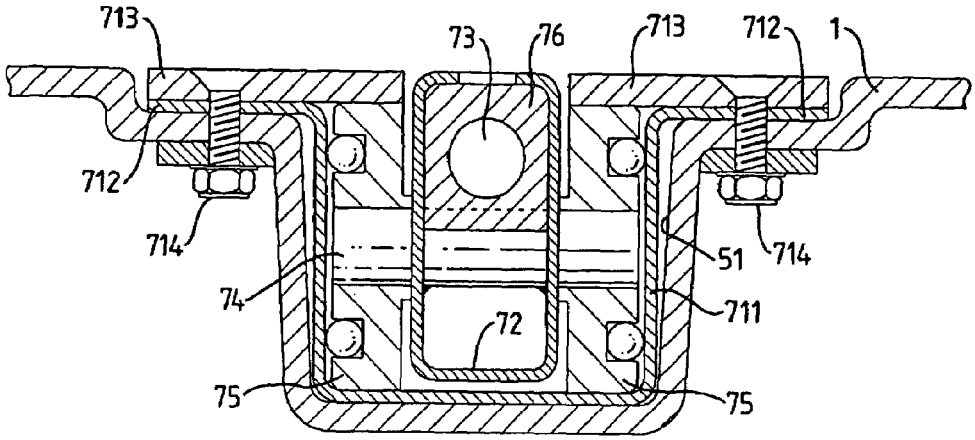
FIG. 10A and FIG. 10B are sections through one of the telescopic guide means.
Figure 10B:
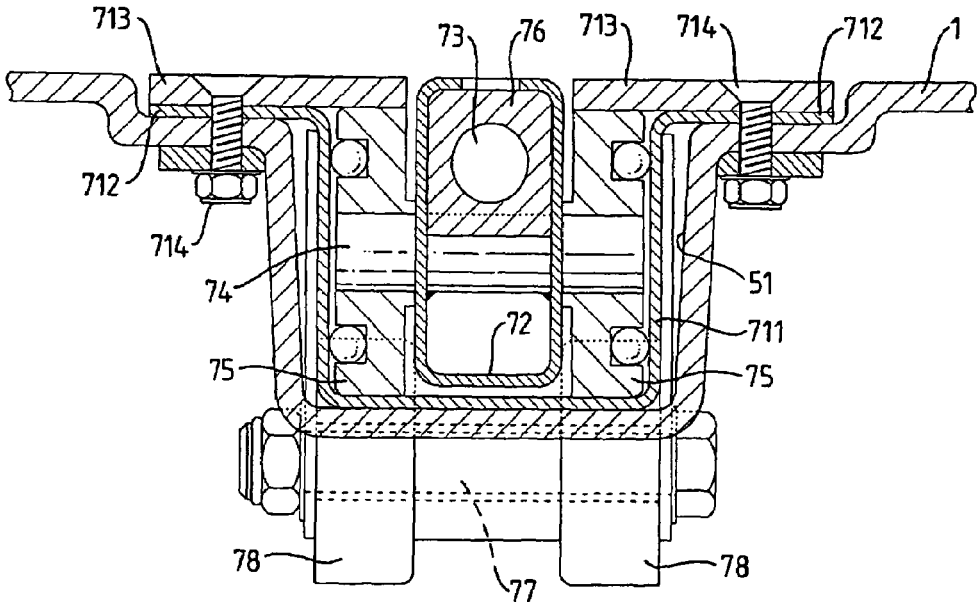

FIGS. 10A and 10B are sections at two different longitudinal positions through the guide means 7 when installed on the hull. FIGS. 10A and 10B show how the static guide trough 71 is fitted within the inclined channel 51 in the sloping surface 61 on the top of the hull tail 5. The channel 51 is formed as an indentation in the hull 1 so as to help to maintain the watertight characteristic of the hull. The static guide trough 71 comprises a lower U-shaped track 711 with integral side flanges 712. The trough 71 also comprises a pair of upper strips 713 which are removable relative to the lower track 711 and serve to hold the beam 72 in the trough 71. Fasteners 714 are used to secure the strips 713 to the flanges 712 and also to secure the guide means 7 in its channel 51 in the hull.

Also, shown in FIG. 10A and FIG. 10B are the axles 74 and rollers 75 which guide the beam 72 as it slides up and down the trough 71. Also visible is the nut 76 which is engaged by the leadscrew 73 to drive the beam 72 up and down.

Also visible in FIG. 10B is a lowermost axle 77 and associated rollers 78 at the bottom end of the trough 71 for supporting the beam 72 as it rides downwards and rearwards out of the trough. This is necessary so that when the beam 72 is fully extended it can be satisfactorily held in a cantilevered configuration protruding out of the rear end of the trough 71.

The platform unit 2 visually appears (as shown in FIG. 1) to be part of the transom by virtue of appearing to be part of the hull. In other words, the platform unit 2 appears to exist as part of the overall hull envelope. In fact, it is "sliced off" as a segment with an overall general wedge-shape which can move up and down an inclined path or track from a seated position on the tail end of the hull to a deployed lower position protruding back beyond the rear end of the hull. Thus, when not needed, the platform unit is less likely to be damaged through being knocked by other boats, users or harbour walls. Also, the platform unit is made more visually attractive by virtue of not overtly advertising its existence and the nature of its function. This effect is assisted by having the side walls of the platform unit 2 appear to be a continuation of the side walls of the adjacent parts of the hull 1. This assists in making the platform unit 2 appear to be part of the overall hull envelope when stowed in its upper position.

When deployed downwards and rearwards to its lower position, the platform unit 2 appears to break out of the overall hull envelope to project rearwardly beyond the hull transom and to enable the platform unit to be partially or wholly immersed in the water. The platform unit 2 appears to slide away from its upper seated position on the hull down an incline corresponding to the slope of the upper surface of the hull tail. The effect can then be reversed by lifting up the platform unit so as to run up the slope to its seated upper position.

The guide means 7 in effect provide slideways which permit the rectilinear running movement of the platform unit as it reciprocates up and down the incline.

Although the preferred embodiment has two guide means 7 transversely spaced apart across the transom of the hull at approximately one thirds and two thirds distance, additional guide means 7 could be provided. Also, in some embodiments, the two tracks provided by the guide means 7 may not be needed, and it may be possible to use just a single central track.

It will be appreciated that the above description is non-limiting and refers to preferred forms of the invention. Many modifications may be made within the scope of the invention. Although features believed to be of particular significance are identified in the appended claims, the applicant claims protection for any novel feature or idea described herein and/or illustrated in the drawings, whether or not emphasis has been placed thereon.

The invention claimed is:

1. A boat comprising:

a hull having a stem and, forwardly of the stern, an upwardly and rearwardly facing incline;

a platform unit which is generally wedge shaped in aide profile with one or more upper platform surfaces and with a sloped bottom which is seated, in a stowed position of the platform unit, on the incline; and guide means for guiding the platform unit to slide backwards down the incline from the stowed position to a deployed position, the guide means comprising at least one elongate guide device carrying the platform unit and mounted along the incline, the at least one guide device comprising a longitudinally-expandable device having a movable member carrying the platform unit and a static guide mounted along the incline.

2. A boat according to claim 1, wherein the static guide is a track mounted along the incline and the movable member is a beam slidably supported by the track.

3. A boat according to claim 2, wherein the movable member is extendable backwards and downwards to a cantilevered position providing the deployed position of the platform unit.

4. A boat according to claim 2, wherein there are first and second such guide devices spaced apart transversely on the incline.

5. A boat according to claim 1, wherein the movable member in extendable backwards and downwards to a cantilevered position providing the deployed position of the platform unit.

6. A boat according to claim 5, wherein there are first and second such guide devices spaced apart transversely on the incline.

7. A boat according to claim 1, wherein there are first and second such guide devices spaced apart transversely on the incline.

8. A boat according to claim 1, wherein the incline includes steps which are revealed when the platform unit is moved backwards and downwards away from its stowed position.

9. A boat according to claim 8, wherein the rear edge of the platform unit has steps and wherein when the platform unit is in the deployed position the steps of the platform unit are aligned with the steps of the incline.

10. A boat according to claim 8, wherein the platform unit forms at least one step recessed into a rear face and the one or more upper platform surfaces of the platform unit and wherein when the platform unit is in the deployed position the at least one step of the platform unit is aligned with the steps of the incline.

11. A boat according to claim 1, wherein the rear edge of the platform unit has steps.

12. A boat according to claim 11, wherein the steps of the platform unit form a stair recessed into a rear face and the one or more upper platform surfaces of the platform unit.

13. A boat according to claim 1, wherein the platform unit comprises a housing defining the one or more upper platform surfaces and the sloped bottom.

14. A boat according to claim 13, wherein the housing has sides which, at least in the stowed position, give the platform unit a width substantially the same as a width between adjacent side wall parts of the stern of the hull.

15. A boat according to claim 14, wherein the housing has a rear which in the stowed position is slightly behind, level with or in front of an adjacent rear wall of the stern of the hull.

16. A boat according to claim 13, wherein the housing has a rear which in the stowed position is slightly behind, level with or in front of an adjacent rear wall of the stern of the hull.

17. A boat according to claim 1, wherein the platform unit when in the stowed position is out of the water and when in the deployed position is at least partly submerged in the water.

18. A boat according to claim 17, wherein the platform unit when in the deployed position has the one or more upper platform surfaces submerged and wherein the platform unit comprises a housing defining the one or more upper platform surfaces and the sloped bottom.

19. A boat according to claim 17, wherein the platform unit when in the deployed position is fully submerged.

20. A boat according to claim 1, further comprising powered actuator means for sliding the platform unit between the stowed and deployed position.

21. A boat according to claim 20, wherein the powered actuator means includes one or more motors which are located inside the hull.

22. A boat according to claim 21, wherein the one or more motors are located under the guide means and are integral therewith.

23. A boat according to claim 1, wherein the guide means is substantially fully recessed into the hull at the incline.

24. A boat according to claim 1, wherein the incline is above the waterline and, in the deployed position, the platform unit protrudes back beyond the stern of the hull.

25. A boat according to claim 1. wherein at least 80% of the length of the platform unit in the longitudinal direction of the boat is seated on the hull when the platform unit is in the stowed position.

26. A boat according to claim 1, wherein at least 90% of the length of the platform unit in the longitudinal direction of the boat is seated on the hull when the platform unit is in the stowed position.

27. A boat according to claim 1, wherein at least 95% of the length of the platform unit in the, longitudinal direction of the boat is seated on the hull when the platform unit is in the stowed position.

28. A boat according to claim 1, wherein the angle of the incline as measured from the horizontal is in the range from 28° to 44°.

29. A boat comprising:

a hull having a stern and, forwardly of the stern, an upwardly and resrwardly facing incline;

a platform unit which is generally wedge shaped in side profile with one or more upper platform surfaces and with a sloped bottom which is seated, in a stowed position of the platform unit, on the incline; and guide means for guiding the platform unit to slide backwards down the incline from the stowed position to a deployed position, the incline comprising steps which are revealed when the platform unit is moved backwards and downwards away from its stowed position.

30. A boat according to claim 29, wherein the rear edge of the platform unit has steps and wherein when the platform unit is in the deployed position the steps of the platform unit are aligned with the steps of the incline.

31. A boat according to claim 29, wherein the platform unit forms at least one step recessed into a rear face and the one or more upper platform surfaces of the platform unit and wherein when the platform unit is in the deployed position the a least one step of the platform unit is aligned with the steps of the incline.

32. A boat comprising:

a hull having a stern and, forwardly of the stern, an upwardly and rearwardly facing incline;

a platform unit which is generally wedge shaped in side profile with one or more upper platform surfaces and with a sloped bottom which is seated, in a stowed position of the platform unit, on the incline;

guide means for guiding the platform unit to slide backwards down the incline from the stowed position to a deployed position;

powered actuator means for sliding the platform unit between the stowed and deployed positions, the powered actuator means comprising one or more motors which are located inside the hull, the one or more motors located under the guide means and integral therewith.

33. A boat comprising:

a hull having a stern and, forwardly of the stern, an upwardly and rearwardly facing incline;

a platform unit which is generally wedge shaped in side profile with one or more upper platform surfaces and with a sloped bottom which is seated, in a stowed position of the platform unit, on the incline; and guide means for guiding the platform unit to slide backwards down the incline from the stowed position to a deployed position, the guide means comprising at least one elongate guide device carrying the platform unit and mounted along the incline, the guide means substantially fully recessed into the hull at the incline.

* * * * *

UNITED STATES PATENT AND TRADEMARK OFFICE

CERTIFICATE OF CORRECTION

PATENT NO. : 7,162,969 B2
APPLICATION NO. : 10/451403
DATED : January 16, 2007
INVENTOR(S) : Simon Houlder et al.

It is certified that error appears in the above-identified patent and that said Letters Patent is hereby corrected as shown below:

Column 6, Line 11, for Claim 1, “stem” should be changed to --stern--;
Column 6, Line 13, for Claim 1, “aide” should be change to --side--;
Column 6, Line 36, for Claim 5, “in” should be changed to --is--;
Column 7, Line 26, for Claim 20, “position” should be changed to --positions--;
Column 8, Line 3, for Claim 29, “resrwardly” should be changed to --rearwardly--;
Column 8, Line 21, for Claim 31, “a” should be changed to --at--

Signed and Sealed this

Eleventh Day of December, 2007

JON W. DUDAS
*Director of the United States Patent and Trademark Office*